United States Patent [19]

Antoon

[11] Patent Number: 5,046,722

[45] Date of Patent: Sep. 10, 1991

[54] EXERCISING DEVICE

[76] Inventor: John M. Antoon, 808 Woodyard Dr. #7, Natchitoches, La. 71457

[21] Appl. No.: 422,104

[22] Filed: Oct. 16, 1989

[51] Int. Cl.[5] ..... A63B 17/00

[52] U.S. Cl. ..... 272/63; 272/112

[58] Field of Search ..... 272/62, 63, 112, 109, 272/111, 113, 144; 108/11, 17; 182/82, 93, 95, 27, 163

[56] References Cited

U.S. PATENT DOCUMENTS

| | | | |
|---|---|---|---|
| 3,501,140 | 3/1970 | Eichorn | 272/62 |
| 3,614,097 | 10/1971 | Blickman | 272/72 |
| 4,759,539 | 7/1988 | Nieppola | 272/63 |
| 4,927,135 | 5/1990 | Nieppola | 272/63 |

*Primary Examiner*—Stephen R. Crow

*Attorney, Agent, or Firm*—John M. Harrison

[57] ABSTRACT

A wall-mounted exercising device which is characterized by a frame secured to the wall of a structure, a pair of articulated upper arms, each having one end attached to the top of the frame in spaced relationship and the opposite end of the arms adapted for engagement with a pair of arm rests to mount a chinning bar, a U-shaped middle arm pivotally secured to the midpoint of the frame, with the parallel opposite ends of the middle arm adapted for swinging upward into a horizontal configuration and braced in this configuration by a pair of lower arms which are pivotally attached to the bottom of the frame in spaced relationship. When not in use, the top and middle arms pivot downwardly and the upper arm pivots upwardly, for folding against the frame to conserve space.

14 Claims, 2 Drawing Sheets

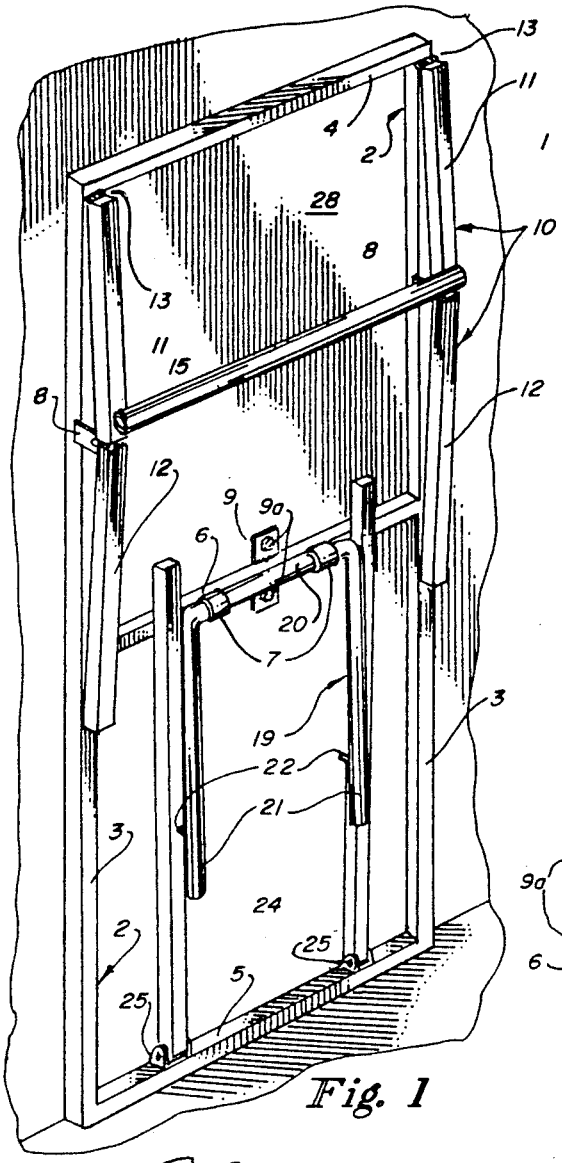
Fig. 1
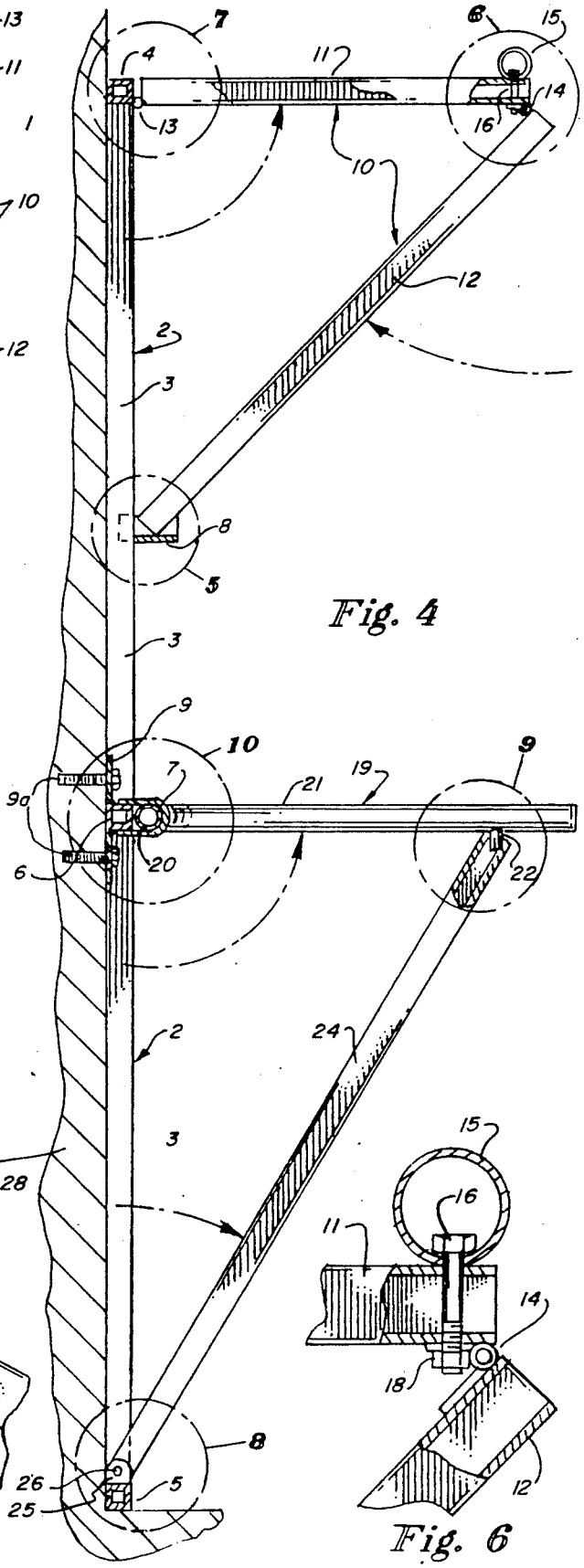
Fig. 4
Fig. 6
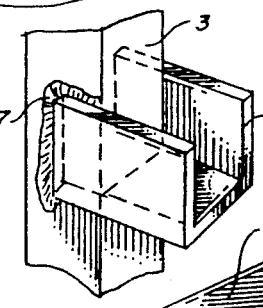
Fig. 5
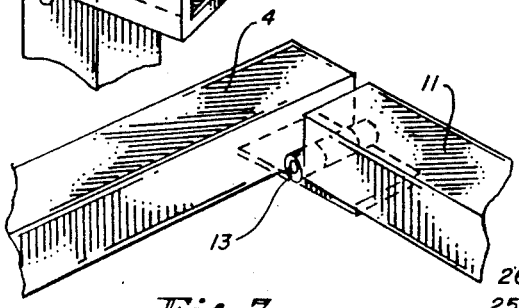
Fig. 7

EXERCISING DEVICE

BACKGROUND OF THE INVENTION

1. Field of the Invention

This invention relates to exercising apparatus and more particularly, to an exercising device which may be wall-mounted and is designed to fold into a space-saving configuration when not in use and extend to facilitate chin-ups, pull-ups, dips and other exercises. In a preferred embodiment, the exercise device is characterized by a wall-mounted frame which receives a pair of articulated upper arms, each having one end hinged to the frame in spaced relationship near the frame top and the opposite ends of the upper arms adapted for seating in a pair of spaced arm rests attached to the frame, to position a chin bar attached to the upper arm at an appropriate level for chinning and pull-up exercises. A U-shaped middle arm is pivotally attached to the center section of the frame and is supported in horizontal configuration by a pair of spaced lower arms, each having one end hinged to the lower portion of the frame and the opposite ends of the lower arms adapted to engage and support the extending ends of the middle arm. The middle arm is positioned at a suitable height to facilitate dips and other exercises. A primary objective of the exercising device of this invention is to provide a portable and collapsible exercise device which can be mounted either permanently or temporarily on the wall of a structure such as a home, office or an indoor gymnasium. Accordingly, the exercising device can be widely used in homes, schools and various institutions for the purpose of chinning exercises, as well as dips, pull-ups and a variety of other exercises which are well known to those skilled in the art and which can be performed by men, women, children of all ages and even individuals who are partially handicapped.

Exercising Devices which are suitable for the home and office as well as schools and other institutions should be sufficiently portable or foldable such that they can be moved indoors and outdoors and from place-to-place as needed to facilitate maximizing space for other activities. Most of the conventional exercising equipment is heavy and expensive and difficult to move or store without considerable effort. Various exercising equipment is available for home and office use and includes such devices as chinning bars which are fastened into or over doorways by means of rubber friction pads or by bolts, screws or teeth which, when located in engaging configuration, may mar the door or door frame. Furthermore, such exercising devices are subject to loosening when tightened in a doorway, for example, and due to improper installation or structural problems, a user can be severely injured by a fall if the device should loosen while being used. Furthermore, height limitations are frequently realized, since the average doorway is rarely over 7 feet high and use by tall persons is therefore difficult or impossible.

2. Description of the Prior Art

Various types of patented exercising devices are well known in the art. An early device is "The Horizontal Bar", detailed in U.S. Pat. No. 1,410,149, dated Mar. 21, 1922, to Williams, et al.. The horizontal bar is characterized by an elongated, round bar suspended in horizontal configuration by a pair of triangular-shaped supports which can be folded for storage. Phillip Margulies U.S. Pat. No. 2,817,522, dated Dec. 24, 1957, to Phillip Marqulies, details a "Portable Gymnastic Device". This device includes an elongated, round bar suspended in horizontal configuration above the ground by a pair of triangular-shaped legs, with a sit-up board located between the bar and the ground to effect various exercises. The entire apparatus is foldable for space conservation. U.S. Pat. No. 3,614,097, dated Oct. 19, 1971, to Harry Blickman, details a "Weight Lifting Exercising Apparatus". The apparatus is designed for toning up various parts of the human body and includes pulley weights, chinning bars, a parallel horizontal bar, a rolling seat, a hand-strengthening roll and a foot exerciser. The apparatus further includes an upright, stationary frame which is adapted to be mounted on a wall or a closet door and a U-shaped frame pivotally mounted on the stationary frame. Pulleys, ropes and weights are mounted on the stationary frame, as well as pivotable rests for the feet and rollers for hand exercising and mounting the rowing seat on the pivotable frame. The weights slide on laterally spaced, vertically-extending bars supported on the side post of the stationary frame. The weights are characterized by a cylindrical members that are combined with one another by movable pins to provide variable weight. An "Adjustable Floor and Ceiling Supported Chinning Bar", is detailed in U.S. Pat. No. 3,642,278, dated Feb. 15, 1972, to John D. Hinckley. The device is set up for installation between a floor and a ceiling and includes two vertical members having rectangular cross-sections, with frictional caps engaging the floor at their lower and upper ends and bolts for longitudinally and laterally engaging the two sides of the vertical members. The vertical members include a number of equally spaced holes longitudinally disposed through their frontal sides, each of the vertical angles further provided with a spring, a spring plunger and a spring chamber connected at their upper ends. The spring plungers are provided with frictional caps for engaging the ceiling, such that the vertical members with their frictional caps then engage the floor. A round, horizontal hand bar extends across and between the vertical members and is connected thereto by a U-shaped bolt extending through each vertical member and secured with wing nuts. The wing nuts are removably secured to each end of the U-shaped bolts to allow for adjustment in the height of the horizontal bar. U.S. Pat. No. 3,709,487, dated Jan. 9, 1973, details a "Compact and Storable Exercising Apparatus". In its folded configuration, the device resembles a chair and may be so utilized. It includes an upright stand member, including a support base, a pair of tubular uprights, a U-shaped frame adjustably telescoped on the uprights and a pair of arm pieces projecting from the legs of the U. A three-piece foldable board, one end of which may be engaged with pairs of supporting hooks on the stand, with the remainder of the board arranged in accordance with the exercising program being undertaken, is also provided. The board may be folded and supported by the arm pieces and uprights to yield the chair-like structure. With the board is disengaged from the stand, the latter may be adjusted in height and utilized in chinning and lift-off exercises. A pair of tubular springs and hand pieces are stored in the hollow arm members and are attachable to points on the stand member for use in various parts of an exercise program. U.S. Pat. No. 4,018,437, dated Apr. 19, 1977, to Roy L. LoPresti, entitled "Multi-Positionable Portable and Collapsible Rectangular Frame Exercising Apparatus with Detachable Support Means", includes a frame made of detachably, telescopically coupled tubular members. Connected to the top cross-member of the frame is a substantially rigid spring member that extends between and removably connects the frame with the door. The spring member includes two parallel, spaced arms. At the opposite end of the spring member are two longitudinally spaced elements that engage, respectively, the front surface of a door, the top of the door and the upper back surface of the door. With the substantially rigid spring member in place for use by an exerciser, the frame will be spaced from the top of the door. U.S. Pat. No. 4,759,539, dated Jul. 26, 1988, to H. Nieppola, details a "Fold-Down Exercise Apparatus", which includes a plane formed by two elongated parts having a pivotal joint arrangement for accomplishing an angle between the parts. The plane of the two parts includes at the lower part, a stationary joint arrangement which is arranged to be fixed substantially above the horizontal base. Locking devices are provided for locking the plane of the two parts into an erected vertical position. Adjustable supports are provided for supporting the plane of the two parts to form an inclined plane between the stationary joint arrangement of the plane of the two parts and the base and for supporting the plane to form an angular plane.

It is an object of this invention to provide an exercising device which is characterized by economy of space when in folded configuration and diversity of exercising options when in extended, functional configuration.

Another object of the invention is to provide an exercising device which may be wall-mounted and is characterized by a pair of upper arms, a U-shaped middle arm and a pair of lower arms which are foldable to facilitate economy of space when not in use and extendable for effecting such exercises as "dips", "chinning", "pull-ups", and the like, in non-exclusive particular.

Still another object of this invention is to provide a foldable, wall-mounted exercising device which can be constructed to accommodate an exerciser of any desired strength, height and physical characteristics.

Still another object of the invention is to provide an exercising device which is fixedly or removably and vertically attached to the wall of a structure and includes a chinning bar which can be extendible for chinning exercises and retractable, in order to conserve space.

Yet another object of the invention is to provide an exercising device which includes U-shaped parallel bars pivotally attached to an upright, vertical frame which may be secured to the wall of a structure, which bars may be pivoted upwardly into horizontal configuration for exercising and folded alongside the frame to effect economy of space.

A still further object of the invention is to provide an exercising device which includes a wall-mounted frame equipped with a pair of spaced, hinged, articulated upper arms provided with a chinning bar, a pivotally mounted, U-shaped middle arm, and spaced, hinged lower arms, which upper arms can be extended and seated in a pair of spaced arm rests to locate the chinning bar in horizontal position for chinning exercises and the middle bar pivoted upwardly into a horizontal configuration and supported by the lower arms, for effecting dips and other exercises.

SUMMARY OF THE INVENTION

These and other objects of the invention are provided in a new and improved exercising device which is characterized by a wall-mounted frame, a pair of articulated, spaced upper arms, each having one end hinged to the frame and the opposite end adapted for seating in a pair of spaced arm rests attached to the frame, for suspending a chinning bar in horizontal position above an exerciser. A U-shaped middle arm having a tubular middle portion and projecting, parallel arm members is pivotally attached to the frame at the middle portion for extending the arm members in horizontal configuration to effectuate dips and other exercises and a pair of spaced lower bars are hingedly attached to the frame at one end for supporting the middle bar in functional configuration. The upper bars, middle bar and lower bars are foldable against the frame for economy of space when the exercising device is not in use.

BRIEF DESCRIPTION OF THE DRAWING

The invention will be better understood by reference to the accompanying drawings, wherein:

FIG. 1 is a perspective view of a preferred embodiment of the exercising device of this invention in folded configuration;

FIG. 4 is a sectional view of the exercising device illustrated in FIGS. 2 and 3, with both the upper arms and the middle arm extended in horizontal, functional configuration;

FIG. 5 is an enlarged, perspective view of a preferred spaced arm rest construction for receiving the free ends of the upper arm;

FIG. 6 is an enlarged view, partially in section, of a preferred hinge arrangement for constructing the articulated upper arms;

FIG. 7 is an enlarged view of a preferred hinged mounting of the articulated upper arms to the upper end of the frame;

DESCRIPTION OF THE PREFERRED EMBODIMENTS

Figures 2, 3, 8, 9, 10:
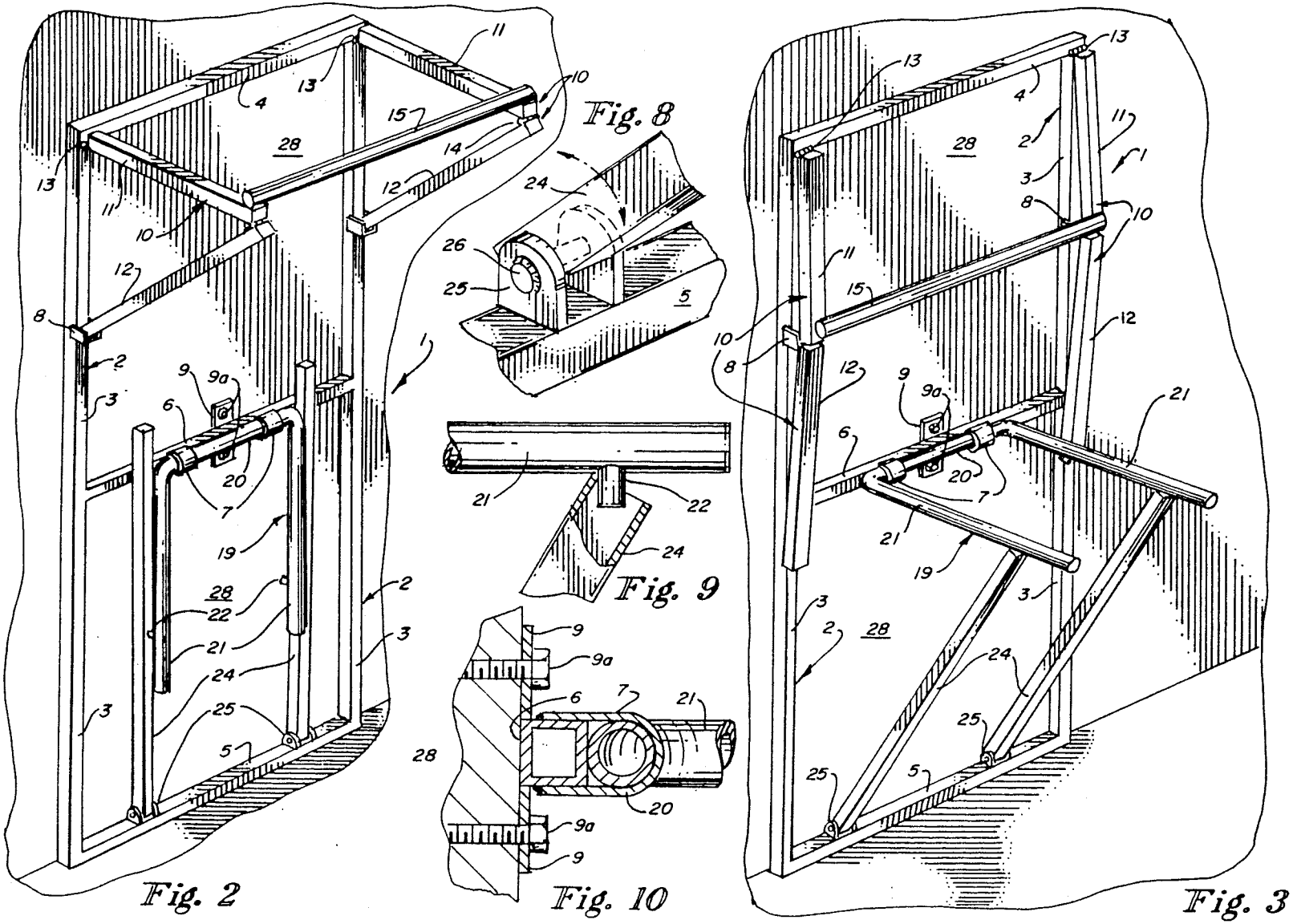
FIG. 2 is a perspective view of the exercising device illustrated in FIG. 1, with the upper arms in extended, functional configuration.
FIG. 3 is a perspective view of the exercising device illustrated in FIG. 1, with the middle arm pivoted upwardly in functional configuration and supported by a pair of spaced lower arms.
FIG. 8 is an enlarged view of a preferred mounting for securing the lower arms to the lower end of the frame.
FIG. 9 is a sectional view of the end portions of the grip segments and stabilizing pins located on the grip segments for engaging the lower arms.
FIG. 10 is an enlarged sectional view of a preferred means for pivotally mounting the middle arm to the frame and the frame to a wall.

Referring initially to FIGS. 1 and 10 of the drawings, the exercising device of this invention is generally illustrated by reference numeral 1 in folded or retracted configuration mounted on a wall 28. The exercising device 1 is characterized by a rectangular-shaped frame 2, which includes a pair of vertical, parallel side frame members 3, a horizontal top frame member 4 connecting the top ends of the side frame members 3 and a horizontal bottom frame member 5 connecting the bottom ends of the side frame members 3. A horizontal middle frame member 6 spans the two side frame members 3 intermediate the top frame member 4 and the bottom frame member 5 and is provided with a bracket 9, which is welded to the middle frame member 6 and attached to the wall 28 by means of a pair of bracket bolts 9*a*. Accordingly, it will be appreciated that the frame 2 can be removed from the wall 28 by removing only the two bracket bolts 9*a*. A pair of U-shaped collars 7 are welded or otherwise secured to the middle frame member 6 in spaced relationship, in order to receive the tubular pivoting segment 20 of a middle arm 19, as detailed in FIG. 10. The U-shaped, tubular middle arm 19 is further characterized by parallel, coextensive grip segments 21, fitted with stabilizing pins 22, which project downwardly from the bottom of the grip segments 21, respectively, when the middle arm 19 is disposed in functional, horizontal configuration, as hereinafter further described.

As further illustrated in FIGS. 1 and 5–8, a pair of U-shaped arm rests 8 are welded to the side frame members 3, respectively, as illustrated in FIG. 5 and the inside segments 11 of a pair of upper arms 10 are hinged to the top portion of the frame 2 at each end of the horizontal top frame member 4 by means of the top hinges 13, respectively, as detailed in FIG. 7. Each upper arm 10 is characterized by an inside segment 11 and an outside segment 12, the latter having one end hinged to the free end of the inside segment 11 by means of a segment hinge 14, as further detailed in FIG. 6. A horizontal chin bar 15 is attached to the extending ends of the inside segments 11 by means of a pair of chin bar bolts 16 and cooperating nuts 18, as illustrated in FIG. 6. A pair of lower arms 24 are also pivotally attached to the bottom frame member 5 of the frame 2 in spaced relationship by means of a clevis 25, respectively, and a clevis pin 26, as illustrated in FIG. 8.

Referring now to FIGS. 2–4 and 9 of the drawings and initially to FIG. 2, when it is desired to extend the upper arms 10 from the frame 2 in order to position the chin bar 15 outwardly of the frame 2 in horizontal, functional configuration, the inside segments 11 of the upper arms 10 are first lifted into a horizontal position as illustrated in FIGS. 2 and 4. The outside segments 12 are then pivoted on the top hinges 13 and the free ends of the outside segments 12 are inserted in the spaced arm rests 8, as further illustrated in FIGS. 2 and 4, in order to support the chin bar 15 in a horizontal configuration, to facilitate chinning or pull-up exercises. Alternatively, when it is desired to extend the grip segments 21 of the middle arm 19 for effecting dips and other exercises, the grip segments 21 are first raised to the horizontal configuration as illustrated in FIGS. 3 and 4, as the tubular pivot segment 20 rotates in the spaced collars 7. The free ends of the lower arms 24 are then pivoted outwardly of the frame 2 to facilitate insertion of the stabilizing pins 22 extending from the ends of the grip segments 21, respectively, in the opening provided in the ends of the lower arms 24, as illustrated in FIGS. 4 and 9. Exercises can then be undertaken using the parallel grip segments 21, as desired.

Referring again to FIGS. 1–4, it will be appreciated by those skilled in the art that both the upper arms 10 and the middle arm 19 can be extended individually or simultaneously, as illustrated in FIG. 4, by the procedure outlined above, as desired. Furthermore, retraction of the upper arms 10, middle arm 19 and the lower arms 24 is effected by reversing the extension procedure, in order to again fold the exercising device in the configuration illustrated in FIG. 1 for economy of space.

Referring again to the drawings, it will be appreciated by those skilled in the art that the frame 2 of the exercising device 1 is constructed of metal such as steel and the arm rests 8, as well as the clevis 25, may be secured to the side frame members 3 and bottom frame member 5, respectively, by means of a weld 17, as illustrated in FIG. 5. Moreover, as illustrated in FIGS. 1–4, the frame 2 is removably and vertically secured to the wall 28 of a structure by means of a bracket 9, which is welded to the middle frame member 6, and a pair of bracket bolts 9*a* or lag screws, as required. If bracket bolts 9*a* are used, threaded inserts (not illustrated) must be tightly seated in the wall 28 to threadably receive the bracket bolts 9*a*. Alternatively, if lag screws are used in place of the bracket bolts 9*a*, these lag screws must be threaded into pilot holes drilled into a stud located in the wall 28, for mounting the frame 2 in the upright position, as illustrated.

It will be appreciated by those skilled in the art that the exercising device 1 of this invention is sturdy and capable of functioning to facilitate a wide variety of exercises, and yet may be moved from place to place. Under circumstances where additional portability may be required, it will be recognized that the exercising device can be mounted on a movable structure or frame (not illustrated) and wheeled or carried from place to place. Moreover, while the upper arms 10 and lower arms 24 are illustrated as constructed of square tubing, it will be recognized that round tubing may also be used, as desired.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An exercising device comprising a frame; a pair of inside segments having one end pivotally secured to the upper end of said frame in spaced relationship and a pair of outside segments having one end pivotally secured to the opposite ends of said inside segments, respectively, for deployment against said frame in retracted configuration and outwardly of said frame in a first exercising configuration; chin bar means secured to said inside segments for supporting an exerciser in said first exercising configuration; a pair of channel members provided on said frame in spaced relationship, said channel members aligned with said outside segments, respectively, for removably receiving and supporting said opposite ends of said outside segments, respectively, when said chin bar means is deployed in said first exercising configuration; middle arm means pivotally carried by said frame beneath said inside segments and said outside segments for deployment inwardly of said frame in retracted configuration and outwardly of said frame in a second exercising configuration; and lower arm means pivotally carried by said frame beneath said middle arm means for deployment inwardly of said frame in retracted configuration and outwardly of said frame for engaging and supporting said middle arm means in said second exercise configuration.

2. The exercising device of claim 1 wherein said middle arm means further comprises a U-shaped middle arm having a tubular pivot segment pivotally attached to said frame, a pair of grip segments extending from said pivot segment in spaced relationship and a pair of pins projecting from said grip segments for engaging the ends of said lower arm means and supporting said grip segments in horizontal relationship in said second exercising configuration.

3. The exercising device of claim 1 wherein said lower arm means further comprises a pair of elongated lower arms having one end pivotally attached to said frame in spaced relationship and the opposite ends of said lower arms adapted for removably engaging and supporting said middle arm means in said second exercising configuration.

4. The exercising device of claim 1 wherein:

(a) said middle arm means further comprises a U-shaped middle arm having a tubular pivot segment pivotally attached to said frame, a pair of grip segments extending from said pivot segment in spaced relationship and a pair of pins projecting from said grip segments; and (b) said lower arm means further comprises a pair of elongated lower arms having one end pivotally attached to said frame in spaced relationship and the opposite ends of said lower arms adapted for removably engaging said pins and supporting said grip segments of said middle arm in horizontal relationship in said second exercising configuration.

5. The exercising device of claim 1 wherein said frame further comprises a horizontal top frame member for pivotally receiving said inside segments, a horizontal middle frame member spaced from said top frame member for pivotally receiving said middle arm means, a horizontal bottom frame member spaced from said middle frame member for pivotally receiving said lower arm means and a pair of vertical, spaced side frame members connected to opposite ends of said top frame member, said middle frame member and said bottom frame member, respectively, and closing said frame.

6. The exercising device of claim 5 wherein said middle arm means further comprises a U-shaped middle arm having a tubular pivot segment pivotally attached to said middle frame member, a pair of grip segments extending from said tubular pivot segment in spaced relationship and a pair of pins projecting from said grip segments for engaging the ends of said lower arm means and supporting said grip segments in horizontal relationship in said second exercising configuration.

7. The exercising device of claim 6 wherein said lower arm means further comprises a pair of elongated lower arms having one end pivotally attached to said bottom frame member in spaced relationship and the opposite ends of said lower arms adapted for removably engaging said pins and supporting said grip segments in said second exercising configuration.

8. An exercising device for mounting on a wall comprising a frame secured to the wall; a pair of inside segments having one end pivotally secured to the upper end of said frame in spaced relationship and a pair of outside segments having one end pivotally secured to the opposite ends of said inside segments, respectively, for deployment against said frame in retracted configuration and outwardly of said frame in a first extended exercising configuration; a chin bar horizontally secured to said inside segments; a pair of generally U-shaped channel members provided on said frame in spaced relationship, said channel members aligned with said outside segments of said upper arm means, respectively, for removably receiving and supporting said opposite ends of said outside segments, respectively, when said inside segments and said outside segments are deployed with said chin bar in said first extended exercising configuration; middle arm means pivotally carried by said frame beneath said inside segments and said outside segments for deployment inwardly of said frame in retracted configuration and outwardly of said frame in a horizontal, second extended exercising configuration; and lower arm means pivotally carried by said frame beneath said middle arm means for deployment inwardly of said frame in retracted configuration and outwardly of said frame for engaging said middle arm means and supporting said middle arm means in said second extended exercising configuration.

9. The exercising device of claim 8 wherein said middle arm means further comprises a U-shaped middle arm having a tubular pivot segment pivotally attached to said frame, a pair of grip segments extending from said pivot segment in spaced relationship and a pair of pins projecting from said grip segments for engaging the ends of said lower arm means and supporting said grip segments in horizontal relationship in said second exercising configuration.

10. The exercising device of claim 9 wherein said lower arm means further comprises a pair of elongated lower arms having one end pivotally attached to said frame in spaced relationship and the opposite ends of said lower arms adapted for removably engaging and supporting said middle arm means in said second extended exercising configuration.

11. The exercising device of claim 8 further comprising bracket means carried by said frame and fastening means adapted for engaging said bracket means and securing said frame to the wall.

12. The exercising device of claim 10 wherein said frame further comprises a horizontal top frame member for pivotally receiving said inside segment, a horizontal middle frame member spaced from said top frame member for pivotally receiving said middle arm means, a horizontal bottom frame member spaced from said middle frame member for pivotally receiving said lower arm means and a pair of vertical, spaced side frame members connected to opposite ends of said top frame member, said middle frame member and said bottom frame member, respectively, and closing said frame.

13. The exercising device of claim 12 further comprising bracket means carried by said middle frame member and fastening means adapted for engaging said bracket means and securing said frame to the wall.

14. An exercising device for mounting on a wall comprising a rectangular frame secured to the wall, said frame having a horizontal top frame member, a horizontal middle frame member spaced from said top frame member, a horizontal bottom frame member spaced from said middle frame member and a pair of vertical frame members spanning said top frame member, said middle frame member and said bottom frame member, a pair of articulated upper arms having one end pivotally attached to said top frame member in spaced relationship for deployment against said frame in retracted configuration and extending outwardly of said frame in a first exercising configuration; a chin bar connecting said upper arms in horizontal configuration; a pair of arm rests mounted on said vertical frame members in spaced relationship, respectively, beneath said upper arms for receiving the opposite ends of said upper arms, respectively, when said upper arms are deployed with said chin bar in said first extended exercising configuration; a U-shaped, tubular middle arm having a center section pivotally carried by said middle frame member beneath said upper arms and parallel grip segments extending from said center section and adapted for deployment inwardly of said frame in retracted configuration and outwardly of said frame in a second extended exercising configuration; and a pair of elongated lower arms pivotally carried by said bottom frame member in spaced relationship beneath said middle arm for deployment inwardly of said frame in retracted configuration and outwardly of said frame for engaging said grip segments of said middle arm and supporting said grip segments in said second extended exercising configuration.

* * * * *